US008592703B2

(12) United States Patent
Johnson et al.

(10) Patent No.: US 8,592,703 B2
(45) Date of Patent: Nov. 26, 2013

(54) TAMPER-RESISTANT, ENERGY-HARVESTING SWITCH ASSEMBLIES

(76) Inventors: Martin R. Johnson, Draper, UT (US); Jan F. Finlinson, Lindon, UT (US); Jeremy P. Willden, Pleasant Grove, UT (US); Robert E. Gooch, Orem, UT (US)

( * ) Notice: Subject to any disclaimer, the term of this patent is extended or adjusted under 35 U.S.C. 154(b) by 246 days.

(21) Appl. No.: 13/104,859

(22) Filed: May 10, 2011

(65) Prior Publication Data

US 2011/0272261 A1 Nov. 10, 2011

Related U.S. Application Data

(60) Provisional application No. 61/333,079, filed on May 10, 2010.

(51) Int. Cl.
*H01H 3/00* (2006.01)
*H01H 13/00* (2006.01)

(52) U.S. Cl.
USPC ..... 200/339

(58) Field of Classification Search
USPC ..... 200/339, 329, 5 R, 5 A, 50.35, 51.03, 200/51.04, 553, 538, 296, 297, 333, 334, 200/293, 43.04, 43.11, 43.13, 43.15, 43.16, 200/43.19, 43.22
See application file for complete search history.

(56) References Cited

U.S. PATENT DOCUMENTS

| | | | | |
|---|---|---|---|---|
| 6,608,253 | B1 * | 8/2003 | Rintz | 174/66 |
| 7,400,239 | B2 * | 7/2008 | Kiko et al. | 340/501 |
| 7,432,463 | B2 * | 10/2008 | Clegg et al. | 200/310 |

* cited by examiner

*Primary Examiner* — Edwin A. Leon
*Assistant Examiner* — Anthony R. Jimenez
(74) *Attorney, Agent, or Firm* — Angus C. Fox, III

(57) ABSTRACT

Tamper-resistant, longer-lasting energy-harvesting switch assemblies that can accommodate longer antennas required for operation in the 315 MHz radio frequency band are provided. In order to accommodate longer antenna that will not fit within the energy-harvesting module, the front major face of the back plate is equipped with a perimetric channel or trough into which a wire antenna can be installed. The problem of rocker wear in prior-art devices caused by abrasive action of the bows is rectified by a redesign of the rocker and the manufacture of a wear-resistant insert that snaps into place at the rear of the rocker. The potential theft problem associated with prior-art devices has been resolved by redesigning the back plate and the retainer clip that engages latches on the redesigned back plate. Non-destructive removal of the retainer clip can be effected only with a special tool.

19 Claims, 17 Drawing Sheets

TAMPER-RESISTANT, ENERGY-HARVESTING SWITCH ASSEMBLIES

This application has a priority date based on Provisional Patent Application No. 61/333,079, which has a filing date of May 10, 2010, and is titled TAMPER-RESISTANT, ENERGY-HARVESTING SWITCH ASSEMBLIES.

BACKGROUND OF THE INVENTION

1. Field of the Invention

The present invention relates generally, to switch assemblies and, more specifically, to energy-harvesting switch assemblies which convert mechanical energy into electrical energy that is used to generate and transmit radio waves, encoded with circuit control signals, to a remote receiver.

2. History of the Prior Art

It is commonly difficult, costly and/or impractical to install wires between existing controlled electrical systems/circuits and new controlled electrical device(s). The level of difficulty and/or impracticality may be attributable to the need to damage or demolish ceilings, floors, or walls, in order to run control wires. Labor costs for installing new wiring can be considerable. This is particularly true if a team of electricians is required to perform the job.

The technology disclosed in this application has been incorporated into wireless control products produced by Ad Hoc Electronics LLC under the ILLUMRA trademark. Ad Hoc Electronics, a member of the EnOcean Alliance, has become the largest supplier in North America, of self-powered, battery-free, wireless lighting control and energy management systems. EnOcean GmbH of Oberhaching, Germany is a pioneer in the design and manufacture of energy-harvesting switching and sensor modules. EnOcean's primary technological contribution was the creation of wireless switches and sensors which operate with minuscule amounts of energy. As a result of this breakthrough, energy-harvesting wireless sensors, of the type produced by EnOcean and its partners, can work where those based on other technologies fail. Energy-harvesting wireless switches and sensors are prime examples of such devices. All ILLUMRA™ products operate using the EnOcean protocol, which is the de-facto standard for energy-harvesting wireless controls. The technology allows energy harvesting ILLUMRA™ transmitters to operate indefinitely without the use of batteries. The motion of a switch actuation, light on a solar cell, or other ambient energy in the environment provide power to ILLUMRA™ transmitters, providing zero-maintenance wireless devices. The ILLUMRA™ product line includes multiple products which operate in the uncrowded 315 MHz band offering greater transmission range than other wireless technologies and minimal competitive traffic.

The ILLUMRA™ hybrid control system combines benefits of ZigBee 802.15.4 Industrial Wireless Relays (IWR) from Ad Hoc Electronics with the benefits of EnOcean-compatible ILLUMRA™ Self-powered Wireless Controls. ILLUMRA™ wireless systems allow users to control electrical loads 150 feet away; the EnOcean+ZigBee hybrid system extends that range up to 1 mile. The system is made up of two component groups: first, an IWR pair designed to provide simple long-range remote control; and second, ILLUMRA™ battery-free wireless light switches and sensors, which are designed to provide easy-to-install light control and energy management systems. Together, these products make up the ILLUMRA™ hybrid system which provides simple, customizable, long range wireless light control, security control, pump station control, electronic sign control, traffic control, factory automation, and more. The hybrid system is especially effective for controlling loads across large open spaces where it would be preferable to not run wire. Examples of such applications include: barns, guest-houses, sports stadiums, tennis courts, boat-houses and garages.

The focus of the present invention are improvements to energy-harvesting switch assemblies. A standard single-rocker, mechanical-energy-harvesting switch assembly is made up of five components: a back plate or carrier; an energy-harvesting module (i.e., the electrical generator, signal encoding circuitry, and radio transmitter) that fits into a recess in the back plate or carrier; a face plate; a rocker; and a retainer clip which holds the entire assembly together. There are three significant problems associated with conventional mechanical-energy-harvesting switch assemblies.

The first problem is that the energy harvesting module—or modules for a multi-switch assembly—are easily removed from the switch assembly by prying off the rocker and popping off the retainer clip. Once these items have been removed, the face plate and the energy-harvesting module can be removed. This is potentially a very expensive problem, as each energy-harvesting module retails for about $100. That fact coupled with the existence of no-questions-asked selling forums, such as the eBay® auction website, makes these devices attractive targets for thieves.

The second problem is related to the use of modules employing two different radio transmission frequencies. Whereas energy-harvesting modules manufactured for the European market typically employ a frequency of 868 MHz, those manufactured for the U.S. market typically employ a frequency of 315 MHz. Given that the components designed for the U.S. market have a much lower operational frequency, a longer antenna is required. That longer antenna is unable to fit within the module itself. There is currently no provision for neatly installing a longer antenna within the switch assembly.

The third problem relates to wear of the rocker where it contacts the spring-loaded energy bows of the energy harvesting switch module. The energy-harvesting switch module has first and second parallel ferromagnetic plates, which are in intimate contact with opposite poles of a tiny cylindrical neodymium-iron-boron (NIB) permanent magnet. A U-shaped ferromagnetic core rockable between the two parallel ferromagnetic plates passes through a solenoid wound on a bobbin. The generation of an electrical pulse requires the application of pressure on the appropriate side of the rocker. When a threshold pressure is reached, which is determined by the magnetic attraction of the permanent magnet to the first ferromagnetic plates, the bow snaps and the ferromagnetic core attaches itself to the second parallel ferromagnetic plate. The snap causes a reversal of magnetic flux in the core, which induces a first current pulse in the solenoid. The first energy pulse is used to transmit a radio signal containing multiple redundant data packets. Different data packets are encoded depending on which switch pad on the energy-harvesting switch module is pushed. Multiple circuits can be controlled by a single module and data packets can include a control signal for each circuit. At a remote receiver, these data packets are decoded to create control signals which establish or modify circuit function in some manner. When the pressure is released, a coil spring causes the ferromagnetic core to snap back to the first ferromagnetic plate, thereby generating a second energy pulse as the bow returns to its original position. The second pulse can be used to generate a secondary signal which can be used, for example, to implement a dimming function for the circuit. The bows, which are designed to operate for tens of thousands of cycles without failure, are typically made of composite plastic materials having a high fiberglass content. The abrasive nature of these composite materials is responsible for rapid wear of the contacting edges of the rockers.

SUMMARY OF THE INVENTION

The present invention provides a tamper-resistant, longer-lasting energy-harvesting switch assemblies that can also accommodate the longer antennas required for operation in the 315 MHz radio frequency band.

In order to accommodate a long antenna that will not fit within the energy-harvesting module, itself, the front major face of the back plate is equipped with a perimetric channel or trough. The switch installer can insert a wire antenna, that extends freely from the energy-harvesting module, into that channel. The wire antenna is installed in much the same manner as the rubber spline that is used to secure the edges of window screen mesh to the perimetric channel of a rectangular window screen frame. Installation of the wire antenna within the channel is not permanent, as it can be easily withdrawn from the channel if, for example, the energy-harvesting module must be replaced. The installed wire antenna is completely invisible once the faceplate is installed on the back plate.

The problem of rocker wear caused by abrasive action of the bows in prior-art devices is rectified by a redesign of the rocker and the manufacture of a wear-resistant insert that snaps into place at the rear of the rocker. The insert is designed so that a much larger contact area pushes against each bow. The wear-resistant polymer material can be polymers such as Teflon®, nylon, or polymer alloys such as acrylonitrile butadiene styrene (ABS)/polycarbonate (PC) alloy. The wear-resistant nature of the insert is expected to at least quadruple the life expectancy of the rocker so that its life expectancy is at least commensurate with that of the energy-harvesting switch module.

The potential theft problem associated with prior-art devices has been resolved by redesigning both the retainer clip, the rocker, and the back plate or carrier so that once the switch assembly is installed as a unit, it cannot be disassembled without the use of a special tool that releases the retainer clip from the back plate or carrier. The rocker has been redesigned with projecting tabs at the top and bottom, and the retainer clip has been redesigned to include recesses that align with the projecting tabs, thereby preventing the rocker from being pried loose from the assembly. The projecting tabs on the rocker, which allowing the rocker to be rotated through its normal oscillatory range, prevent the upper and lower edges from being pried away from the retainer clip. The retainer clip has been further redesigned to include snap arms with loops that capture latches on a redesigned back plate. A special laminar latch release tool is designed to slip between rocker and the retainer clip and release the latches holding the switch assembly together. As latch release tools will be sold only in combination with a switch assembly, they will not be generally available for use by thieves.

DETAILED DESCRIPTION OF THE PREFERRED EMBODIMENT(S)

The various aspects of the invention will be now be described in detail with reference to the attached drawing figures. Drawing FIGS. 1 to 37 cover a surface-mount first embodiment improved single rocker switch assembly that is designed primarily for European applications. In Western Europe internal walls are typically constructed with brick and mortar. Electrical wiring is typically run on the surface of interior walls and outlet and switch boxes are almost always surface mounted.

Figure 1:
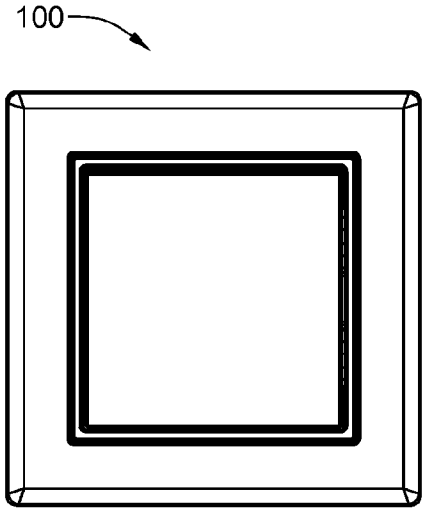
FIG. 1 is a front elevational view of a surface-mount first embodiment improved single-rocker energy-harvesting switch assembly designed primarily for European applications.

Referring now to FIG. 1, a surface-mount first embodiment improved single-rocker switch assembly 100 has been designed so that, externally, it is virtually identical to prior-art single-rocker energy-harvesting switch assemblies.

Figure 2:
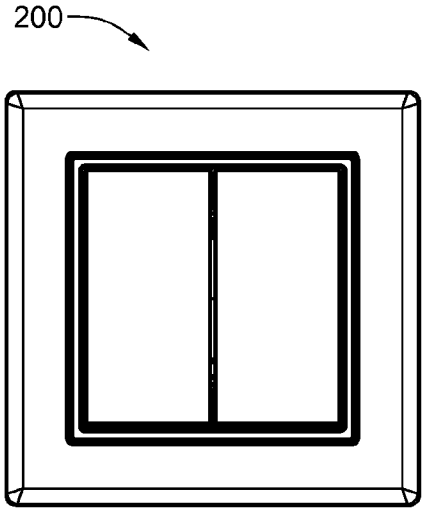
FIG. 2 is a front elevational view of a first embodiment improved dual-rocker energy-harvesting switch assembly.

Referring now to FIG. 2, a surface-mount first embodiment improved double-rocker switch assembly 200 has been designed so that, externally, it is virtually identical to prior-art double-rocker energy-harvesting switch assemblies. In this view, the double rockers, the face plate, and the retainer clip, which secures the faceplate to the energy-harvestng switch module (not shown in this view), are visible.

Figure 3:
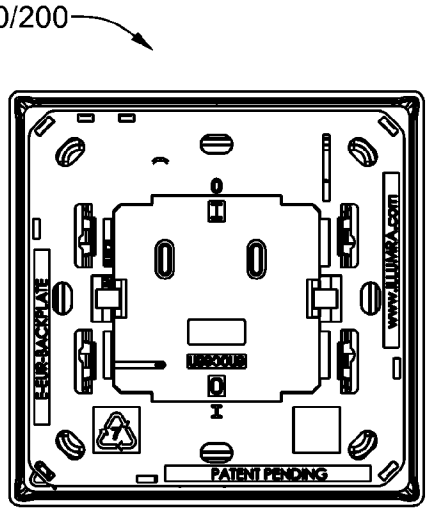
FIG. 3 is a rear elevational view of a first embodiment improved single or dual rocker switch assembly.

Referring now to FIG. 3, the rear of the first embodiment improved single or dual rocker switch assembly, 100 or 200, appears virtually identically to prior-art, energy-harvesting switch assemblies. Modifications relating to the improvements are internal to the assembly.

Figure 4:
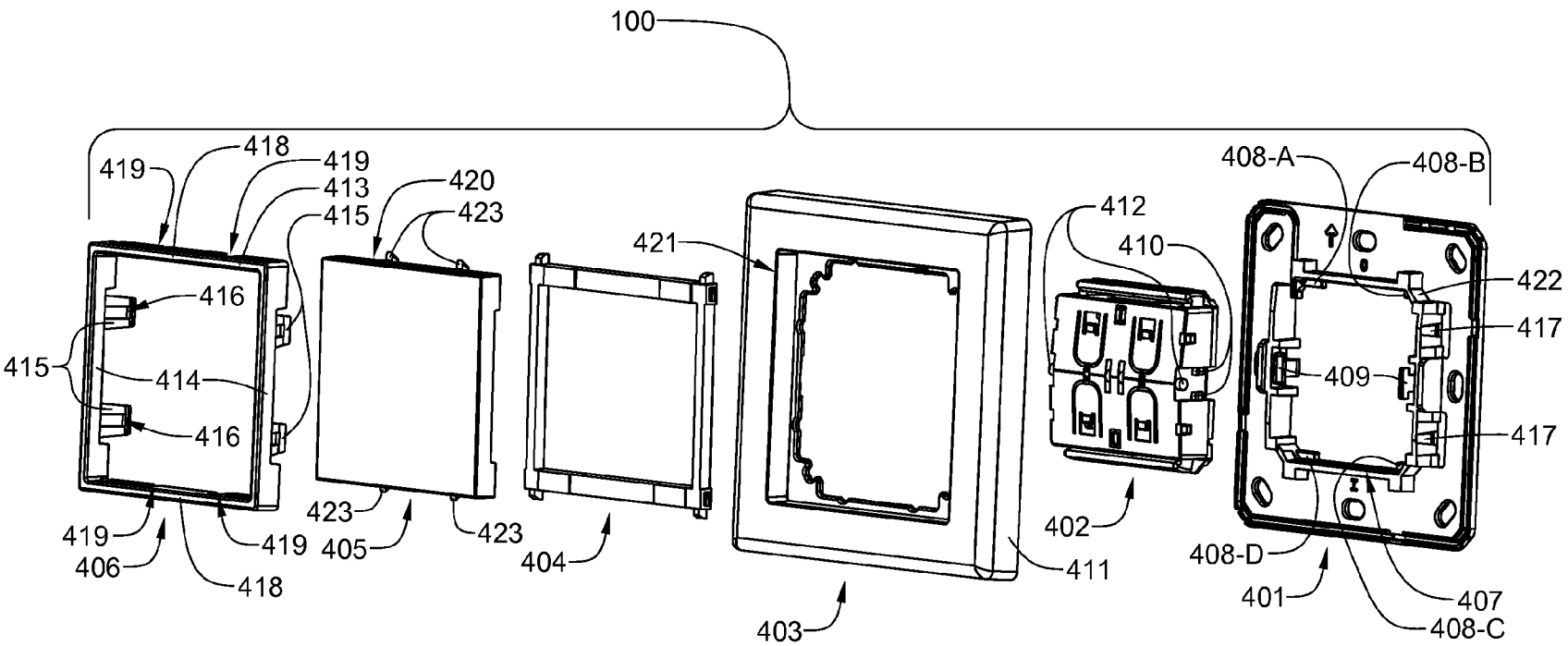
FIG. 4 is an exploded isometric view of a first embodiment improved single-rocker energy-harvesting switch assembly.

Referring now to FIG. 4, a complete first embodiment improved single-rocker, energy-harvesting switch assembly 100 includes the following components: a redesigned back plate 401; an energy-harvesting switch module 402; a face plate 403; a new wear insert 404; a redesigned rocker 405; and a modified retainer clip 406. In order to assemble the improved first embodiment module 100, the energy-harvesting switch module 402 is inserted in the central recess 407 of the back plate 401. It will be noted that four projections 408-A, 408-B, 408-C and 408-D, act as rear stops in the containment of an installed module. The T-shaped clips 409 on opposite sides of the central recess 407 snap over the spaced-apart projections 410 on the energy-harvesting switch module 402, thereby locking the latter in place within the recess 407. Next, the face plate is installed over the switch module 402 so that the edges of its rectangular flange 411 are in substantial contact with the back plate 401. The wear insert 404 is snapped onto the rear of the rocker 405 and the rocker is snapped onto the outer pivot pins 412 of the switch module 402. It will be noted that the retainer clip 406 has a rectangular beam frame 413. Each side beam 414 is equipped with a pair of snap arms 415 having apertures 416 that will capture latches 417 on the redesigned back plate 401. In addition, each of the top and bottom beams 418 (the clip is reversible) is equipped with a pair of notches, or recesses, 419. Prior-art retainer clips have neither the snap arms 415 nor the notches 419. Finally, in order to secure the switch assembly 100 as a unit, the retainer clip 406 is inserted between the rocker outer periphery 420 and the aperture 421 in the face plate 403. When fully seated, the snap arms 415 of the retainer clip 406 engage four latches 417 on the outer surface of the wall 422 that surrounds the central recess 407. The rocker 405 is secured within the switch assembly 100 by four tabs 423 at each end thereof which are positioned within recesses in the top and bottom beams 418 of the retainer clip 406. It should be noted that both the energy-harvesting switch module 402 and the face plate 403 is identical to prior-art face plates, as no modifications need be made thereto to implement the objects of the invention. It should be noted that the back plate 401 is also be referred to as a carrier.

Figure 5:
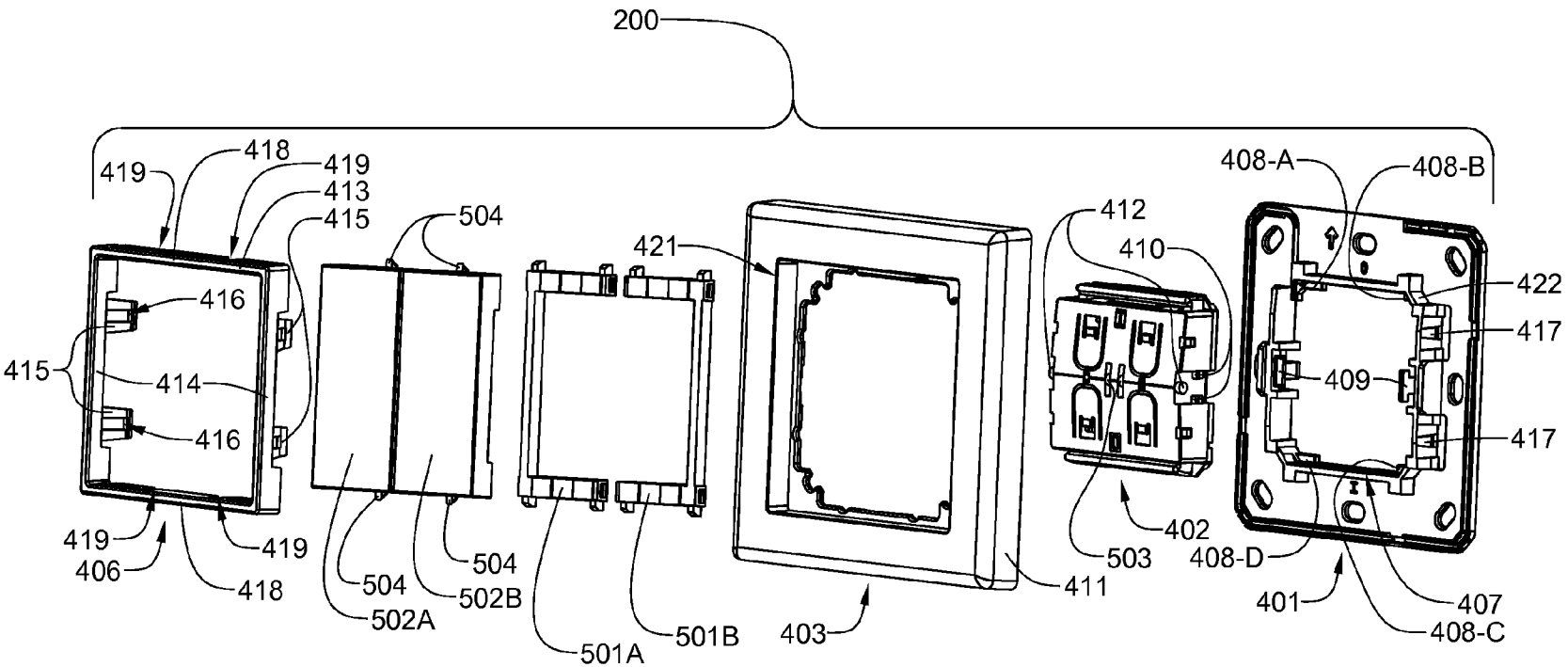
FIG. 5 is an exploded isometric view of a first embodiment improved dual-rocker energy-harvesting switch assembly.

Referring now to FIG. 5, a complete first embodiment improved dual-rocker, energy-harvesting switch assembly 200 includes the following components: the redesigned back plate 401; the energy-harvesting switch module 402; the face plate 403; a pair of new, identical wear inserts 501-A and 501-B; a dual-rocker set consisting of a pair of identical half-width rockers 502-A and 502-B; and the modified retainer clip 406. The rockers and wear inserts are the only components that are different between the single-rocker switch module 100 and the dual-rocker switch module 200. The dual-rocker switch module 200 assembles in a nearly identical way. The differences are that each half-width rocker 502-A and 502-B receives its own wear insert and each half-width rocker 502-A snaps onto one outer pivot pin 412 and one inner pivot pin 503.

Figure 7:
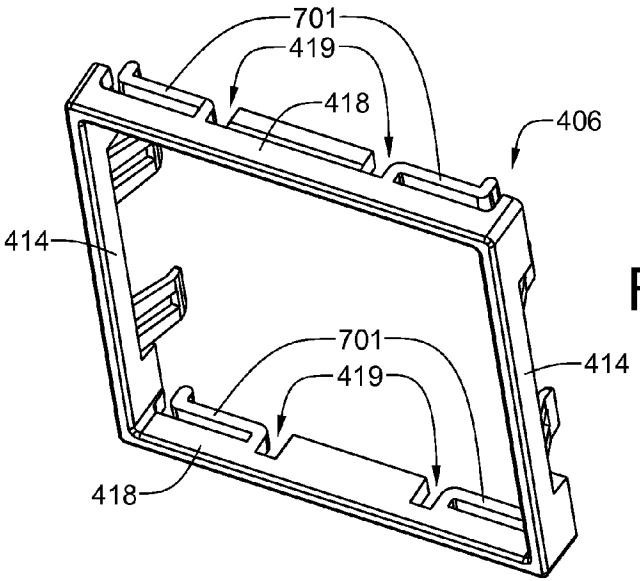
FIG. 7 is an isometric view, from a front/side/end vantage point, of the first embodiment retainer clip.
Figure 8:
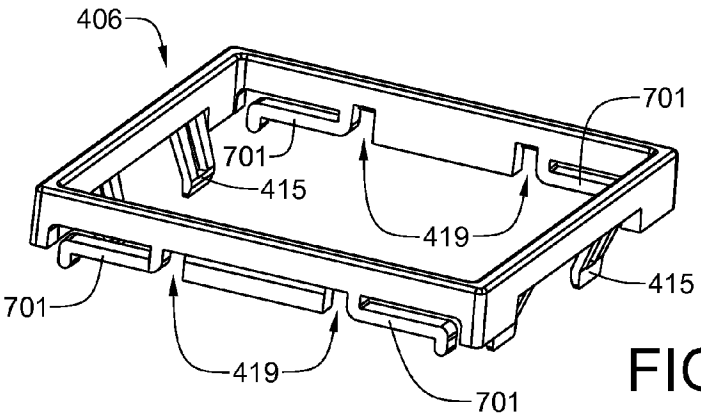
FIG. 8 is an alternative isometric view, from a front/side/end vantage point, of the first embodiment retainer clip.
Figure 6:
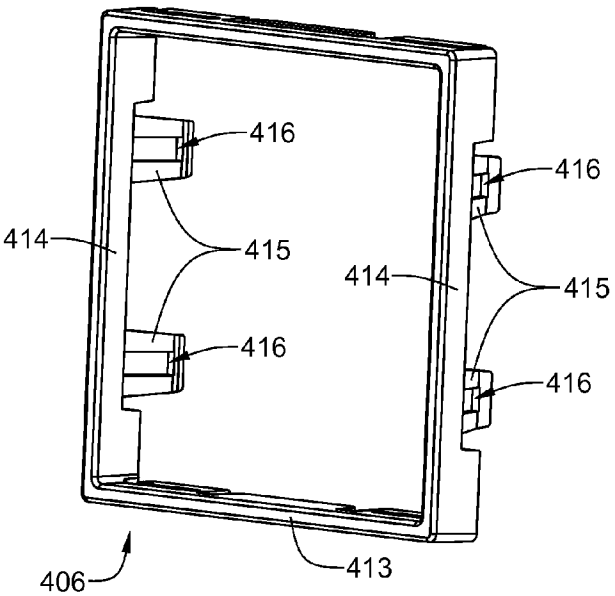
FIG. 6 is an isometric view of the first embodiment retainer clip.
Figure 10:
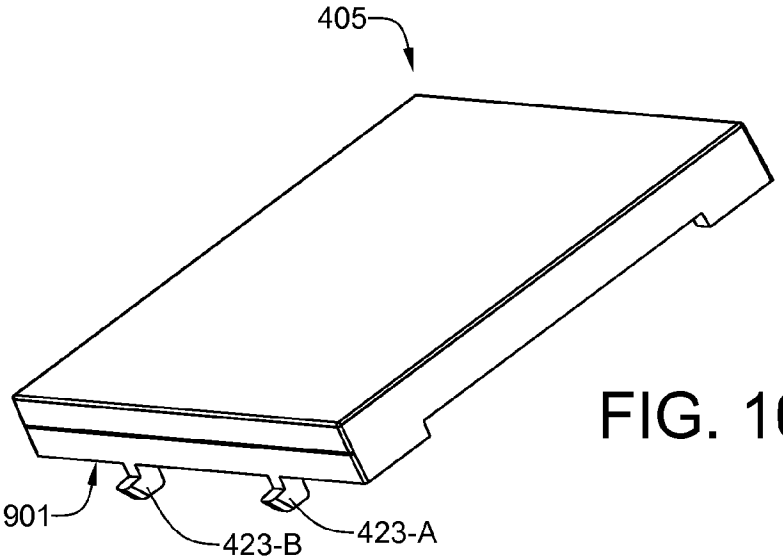
FIG. 10 is an isometric view, from front/side/end vantage point, of the first embodiment single rocker.
Figure 11:
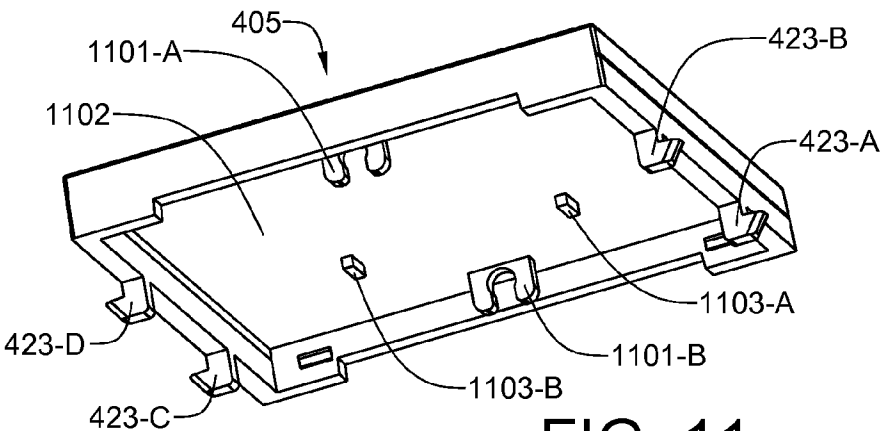
FIG. 11 is an isometric view, from a rear/side/end vantage point, of the first embodiment single rocker.
Figure 9:
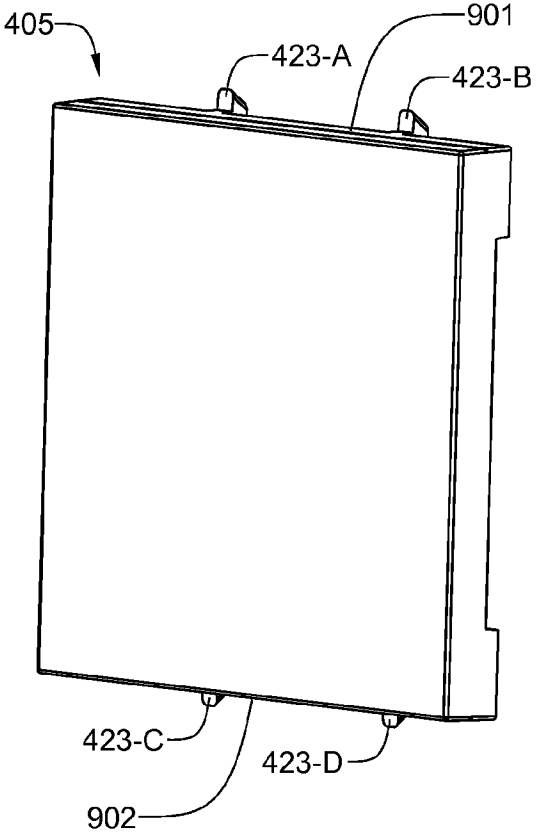
FIG. 9 is an isometric view of a first embodiment single rocker.
Figure 12:
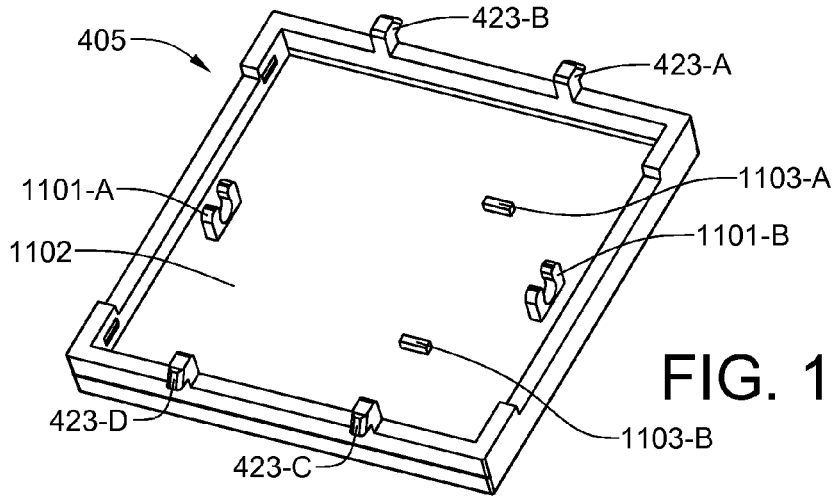
FIG. 12 is an isometric rear view of a first embodiment single rocker without the wear inserts installed.

Referring now to drawings of the first embodiment retainer clip 406 in FIGS. 6 through 8, the details thereof are much more apparent, especially in FIGS. 7 and 8. As previously stated, the retainer clip 406 has a rectangular beam frame 413. Each side beam 414 is equipped with a pair of snap arms 415 having apertures 416 that capture latches 417 on the redesigned back plate 401. In addition, each of the top and bottom beams 418 (the clip is reversible) is equipped with a pair of notches, or recesses, 419. Prior-art retainer clips have neither the snap arms 415 nor the notches 419. It will be noted that in FIGS. 7 and 8, four integral S-shaped springs 701 are visible. These springs push against the cover plate 403 and not only prevent it from rattling when the retainer clip 406 is installed in the switch assembly 100 or 200, but also places the snap arms 415 under slight tension, which ensures that they are more likely to remain in permanent engagement with the latches 417 on the outer surface of the wall 422 of the base plate 401.

Referring now to the drawings of the first embodiment single rocker in FIGS. 9 through 12, the details thereof are much more apparent. The first embodiment single rocker 405 is equipped with a pair of tabs 423-A and 423-B on the upper edge 901 thereof and with a pair of tabs 423-C and 423-D on the lower edge 902. It will be noted—particularly in FIGS. 11 and 12—that a pair of snap collars 1101-A and 1101-B project from the rear surface 1102 of the single rocker 405. These snap collars engage the outer pivot pins 412 of the switch module 402. It will be further noted in FIGS. 11 and 12 that a pair of actuators 1103-A and 1103-B project from the rear surface of the single rocker 405. Because the actuators 1103-A and 1103-B are offset to one side of the rocker 405, the rocker—unlike the retainer clip 406—cannot be reversed without functional consequences. The energy-harvesting switch module 402 has four switch pads on the front surface thereof. Pressing any one of the four switch pads will cause the switch module 402 to generate a unique data packet, which codes for a signal which modifies the characteristics (e.g., ON, OFF, or dimming) for one of two circuits. The switch pads are arranged in a rectangular pattern, with each right or left vertically-oriented pair potentially controlling a single circuit. When a single rocker 405 is selected to assemble the switch assembly 100, only one pair of switch pads can be actuated on the switch module 402 to control functions (e.g., ON, OFF, or dimming) of a single circuit. Thus, if the single rocker 405 is rotated 180 degrees in the same plane, actuation shifts from one switch pad pair to the other. When half-width rockers 502-A and 502-B are selected to assembly the switch assembly 200, two circuits can be controlled.

Figure 13:
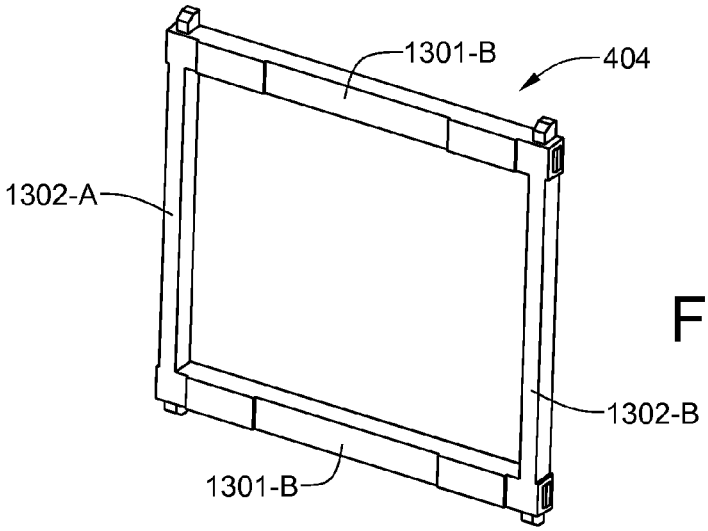
FIG. 13 is an isometric view of the wear insert for a first embodiment single rocker.

Referring now to FIG. 13, a first embodiment single rocker wear insert 404 includes a pair of wear bars 1301-A and 1301-B, which are interconnected at their ends by side rails 1302-A and 1302-B. The single rocker wear insert 404 is designed to snap onto the rear of a single rocker 405.

Figure 14:
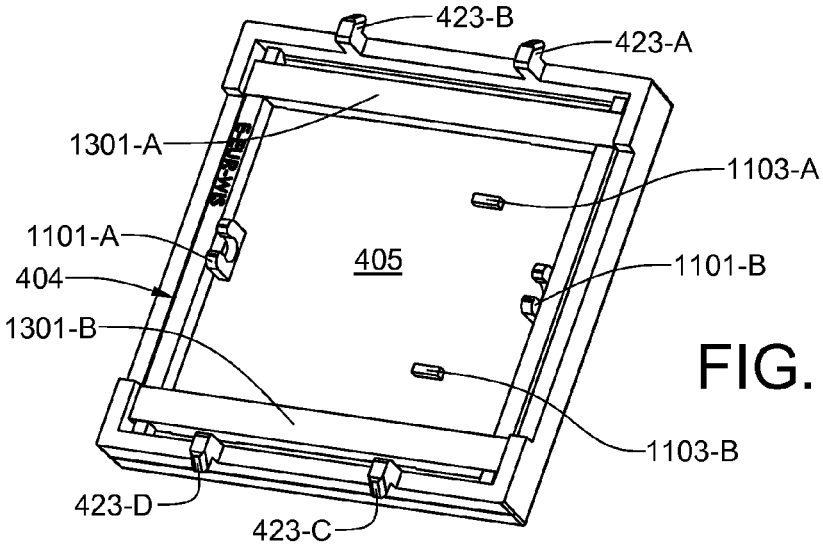
FIG. 14 is an isometric rear view of the first embodiment single rocker following installation of the wear inserts thereon.

Referring now to FIG. 14, a first embodiment single rocker wear insert 404 has been snapped onto the underside of the single rocker 405. Prior-art rockers do not use wear bars that are integral with the single rocker 405, as the size of the wear bars would necessarily cause molding blemishes on the exposed front side of the rocker. Thus, prior-art rockers have only small nipples, or bumps, which project from the rear surface of the rocker. Though the aesthetic qualities of the rocker are preserved by the use of these small nipples, they tend to wear out quickly as a result of the friction between the nipple on the rocker and the bow on the energy-harvesting switch module 402.

Figure 15:
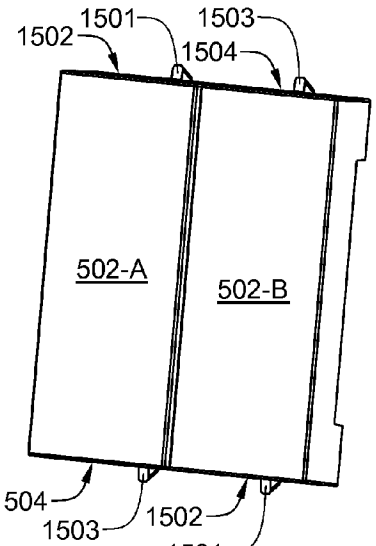
FIG. 15 is an isometric view of a first embodiment dual-rocker set.
Figure 16:
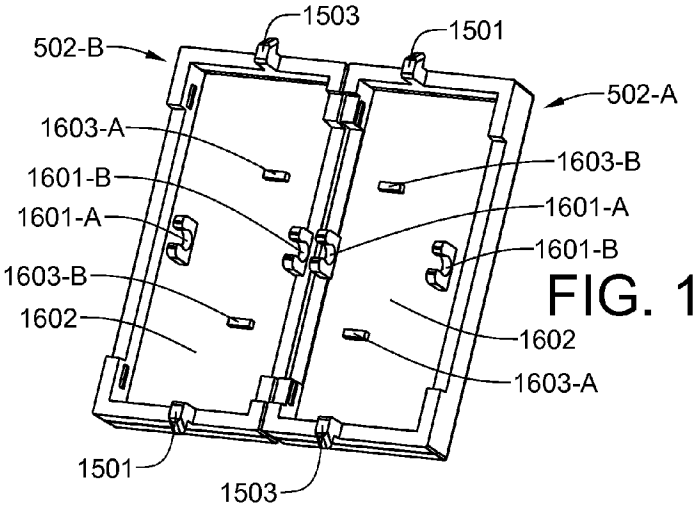
FIG. 16 is an isometric rear view of a first embodiment double rocker set without the wear inserts installed.

Referring now to FIGS. 15 and 16, the first embodiment dual rocker set 502 consists of first and second identical half-width rockers 502-A and 502-B. Each half-width rocker 502-A and 502-B is equipped with a single tab 1501 on an upper edge 1502 and a single tab 1503 on a lower edge 1504. Although both rockers of the dual rocker set 502 are identical, they are not bilaterally symmetrical. It will be noted in FIG. 16 that a pair of snap collars 1601-A and 1601-B project from the rear surface 1602 of each half-width rocker 502-A and 502-B. The snap collars 1601-A and 1601-B on a single half-width rocker 502-A or 502-B snap onto one outer pivot pin 412 and the closest inner pivot pin 503. It will be further noted in FIG. 16 that a pair of actuators 1603-A and 1603-B also project from the rear surface 1602 of each half-width rocker 502-A and 502-B. Because of the lateral asymmetry, once the half-width rockers 502-A and 502-B are installed on the switch module 402 in a particular left-right configuration, neither rocker can be reversed top to bottom. However, the left and right half-width rocker 502-A and 502-B can be interchanged by rotating both of them 180 degrees in a plane with no functional change to actuation of the switch module 402. The tabs 1501 and 1503 on the half-width rockers 502-A and 502-B fit into the notches or recesses 419 of the first embodiment retainer clip 406, which is identical for both single and double rocker implementations. The energy-harvesting switch module 402 has four switch pads on the front surface thereof. As previously stated, for a single-rocker implementation, only two of the four switch pads on the switch module 402 are used in the control of a single circuit. For a double-rocker implementation which controls two circuits, all four switch pads are used—one pair for each circuit.

Figure 17:
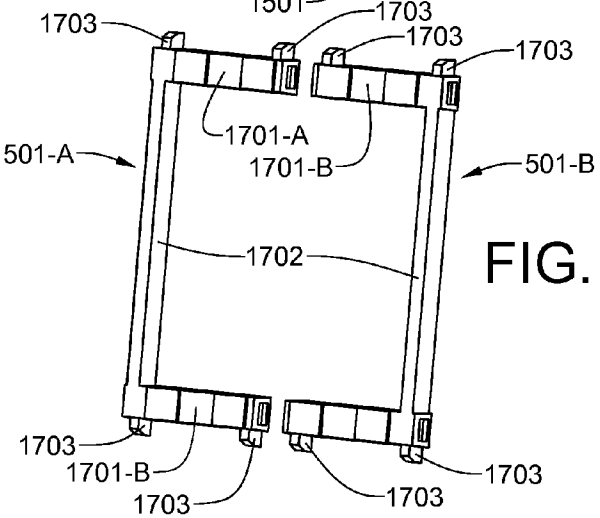
FIG. 17 is an isometric view of the wear inserts for a first embodiment dual-rocker set.

Referring now to FIG. 17, a pair of first embodiment dual-rocker wear inserts 501 includes first and second half-width wear inserts 501-A and 501-B. Each wear insert 501-A or 501-B includes a pair of wear bars 1701-A and 1701-B, which are interconnected at one end by a single side rails 1702. Each half-width wear insert 501-A and 501-B is designed to snap onto the rear of a single half-width rocker 502-A and 502-B.

Figure 18:
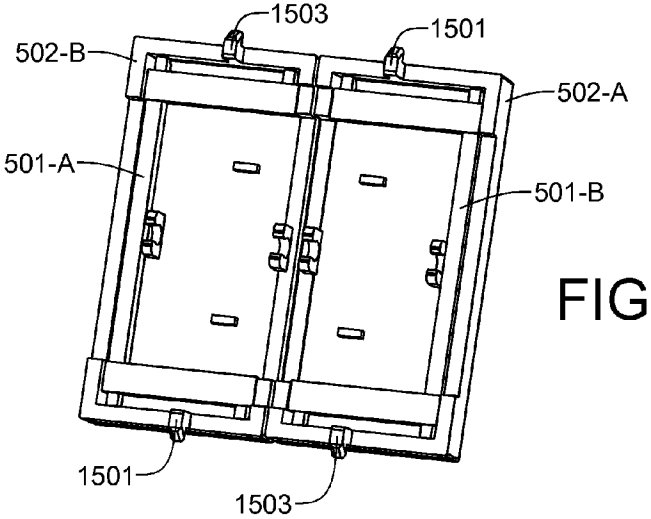
FIG. 18 is an isometric rear view of the first embodiment dual-rocker set following installation of the wear inserts thereon.

Referring now to FIG. 18, a half-width wear insert 501-A and 501-B have been snapped onto the underside of half-width rockers 502-A and 502-B, respectively. Prior-art half-width rockers do not use wear bars that are integral with each half-width rocker, as the size of the wear bars would necessarily cause molding blemishes on the exposed front side of the rocker. Thus, prior-art half-width rockers have only small nipples, or bumps, which project from the rear surface of the rocker. Though the aesthetic qualities of the rocker are preserved by the use of these small nipples, they tend to wear out quickly as a result of the friction between the nipple on the rocker and the bow on the energy-harvesting switch module 402.

Figure 19:
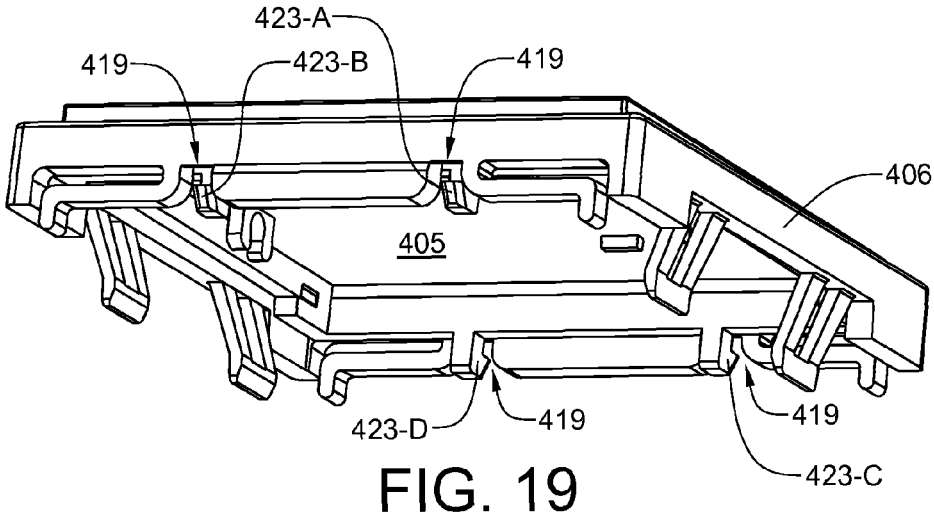
FIG. 19 is an isometric view, from a rear/side/end vantage point, of a first embodiment single rocker nested in a retainer clip.

Referring now to FIG. 19, the assembly consisting of a first embodiment single rocker 405 and a retainer clip 406 show how the tabs 423-A and 423-B on the upper edge 901 of the single rocker 405 and the tabs 423-C and 423-D on the lower edge 902 of the single rocker 405 fit into the recesses 419 on the retainer clip 406. The single rocker 405 is thereby captured by the retainer clip 406, making removal of the single rocker 405 impossible without either removing the retainer clip 406 or destroying either the single rocker 405 or the retainer clip 406 or both the rocker 405 and the clip 406.

Figure 20:
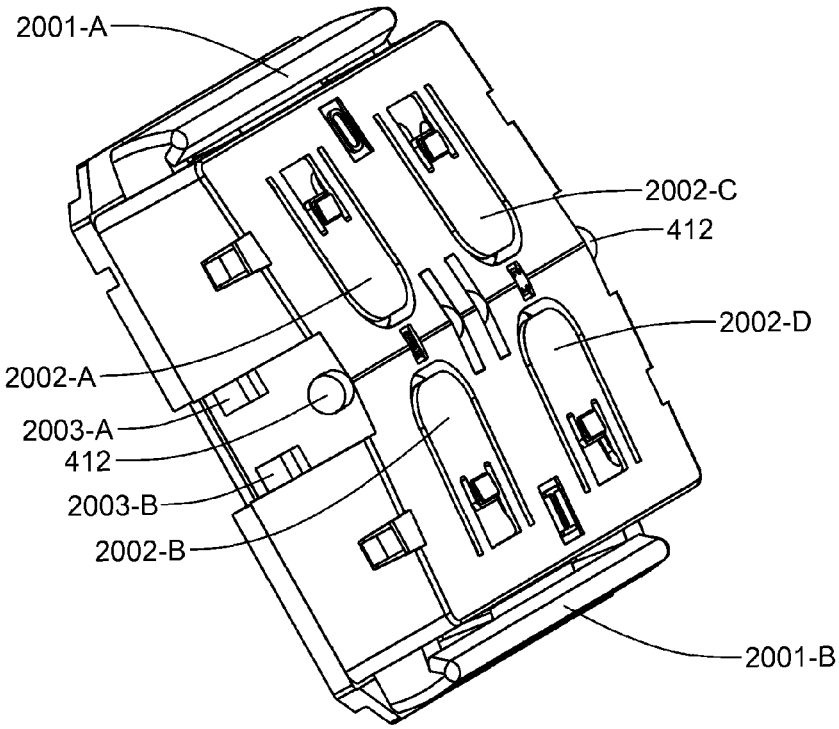
FIG. 20 is an isometric view of an energy-harvesting switch module, with both energy bows and all four switch pads fully visible.

Referring now to FIG. 20, an enlarged view of the energy-harvesting module 402 shows both energy producing bows 2001-A and 2001-B and all four switch pads 2002-A, 2002-B, 2002-C and 2002-D are fully visible. Switch pads 2002-A and 2002-B are responsible for generating signals which establish the characteristics (e.g., ON, OFF, or dimming) of a first remote circuit while switch pads 2002-C and 2002-D are responsible for generating signals which establish the characteristics of a second remote circuit. The generation of an electrical pulse requires the application of pressure on a particular bow 2001-A or 2001-B by pushing on the appropriate side of the rocker. Pressure on the rocker first selects a desired push button, and when a threshold pressure is reached, the bow snaps to a position at an elevated potential energy state, causing a permanent magnet to move adjacent an inductor, thereby releasing a pulse of electrical energy. The energy is used to transmit a radio signal containing multiple redundant data packets which encode for the signal assigned to the switch pad of the switch module 402 that was pushed. Different data is encoded by pushing different switch pads. For a dual-rocker implementation, if both half-rockers are pushed simultaneously, it is possible to send redundant data packets, each of which encodes for a control signal affecting both circuits which the module controls. At a remote receiver, the data packets are decoded to create control signals for one or both of the controlled remote circuits. When the finger pressure on the rocker or rockers is released, the bow 2001-A or 2001-B returns to its original position. As explained in the Background of the Invention section, the release of pressure on the rocker can generate a followup signal, which can be used for example. It should be noted that there are a pair of spaced-apart projections 2003-A and 2003-B on each side of the switch module (only one side of the module 402 is visible in this view).

Figure 21:
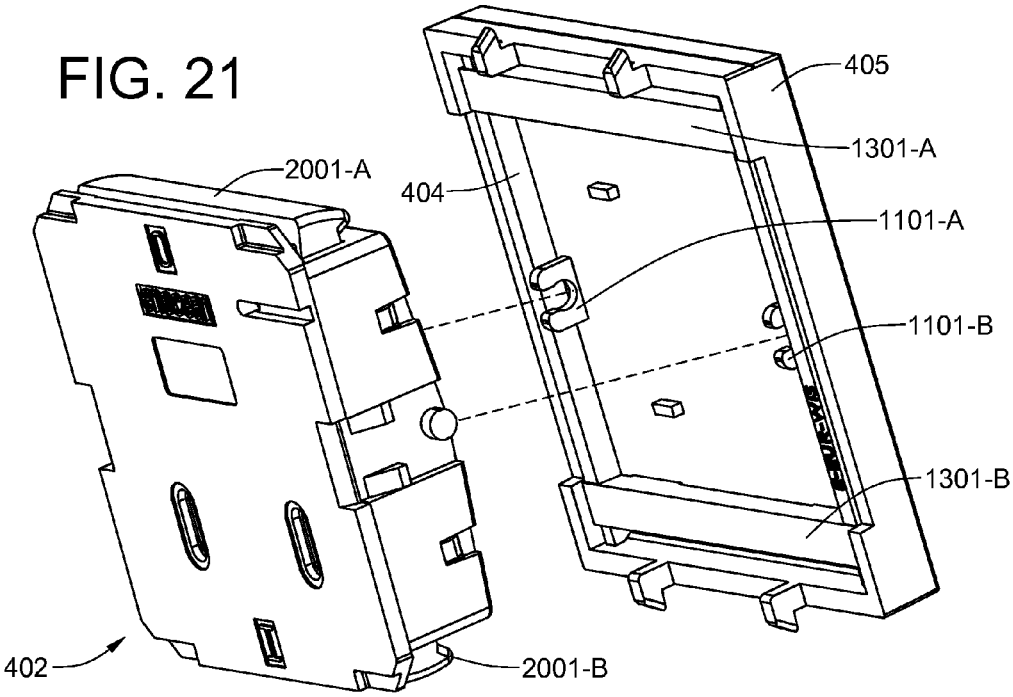
FIG. 21 is an isometric exploded view of a energy-harvesting switch module and a first embodiment single rocker with wear inserts attached thereto.

Referring now to FIG. 21, this exploded view shows how the wear bars 1301-A and 1301-B of the single rocker wear insert 404 will contact the energy producing bows 2001-A and 2001-B of the energy-harvesting switch module 402. In addition it shows how the pair of snap collars 1101-A and 1101-B, which project from the rear surface 1102 of the single rocker 405 will engage the outer pivot pins 412 of the switch module 402.

Figure 22:
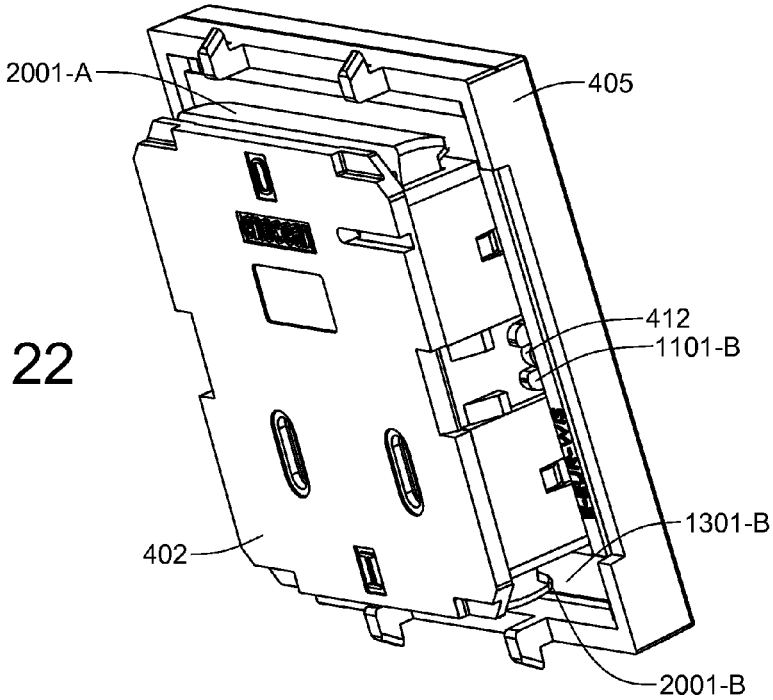
FIG. 22 is an isometric view of an assembly which includes an energy-harvesting module and a single rocker.

Referring now to FIG. 22, a single rocker 405 is shown attached to the energy-harvesting switch module 402. The wear bars 1301-A and 1301-B of the single rocker wear insert 404 make contact with the energy bows 2001-A and 2001-B, respectively along the entire length of each bow. As a result of this design, the wear bars 1301-A and 1301-B do not wear out quickly.

Figure 24:
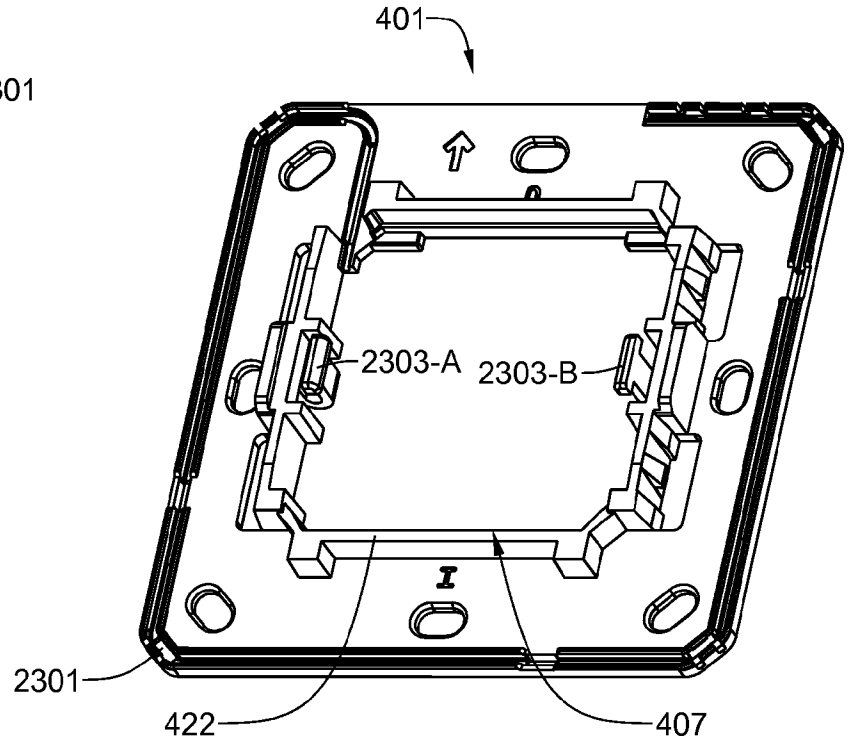
FIG. 24 is an isometric view of a surface-mount first embodiment back plate showing the perimetric channel or trough that can be used for the installation of an external wire antenna.
Figure 23:
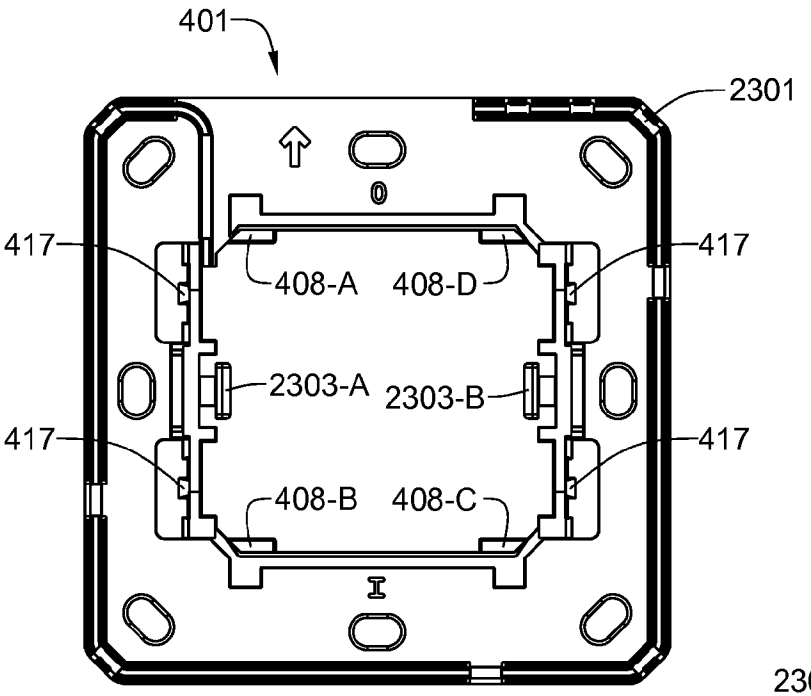
FIG. 23 is a front elevational view of a surface-mount first embodiment back plate showing the perimetric channel or trough that can be used for the installation of an external wire antenna.

Referring now to FIGS. 23 and 24, a flush-mount first embodiment back plate 401 has been modified from those of the prior art to include four latches 417 on the outer surface of the wall 422 that surrounds the central recess 407 of the back plate 401. In addition, the back plate 401 has been further modified to include a perimetric channel or trough 2301 that can be used for the installation of an external wire antenna that protrudes from the energy-harvesting switch module 402. The four latches 417 will engage the snap arms 415 of the retainer clip 406 when the latter is installed in the switch assembly. It will be noted that four projections 408-A, 408-B, 408-C and 408-D at the rear of the first embodiment back plate 401, which act as rear stops to limit rearward travel of the switch module 402 when it is installed in the central recess 407. It will be further noted that there are a pair of T-shaped clips 2303-A and 2303-B on opposite sides of the central recess 407. These T-shaped clips 2303-A and 2303-B snap over the spaced-apart projections 2003-A and 2003-B on each side of the switch module 402, thereby limiting forward movement of the switch module 402 when it is installed within the central recess 407. Thus, the perimetric wall 422 of the central recess 407, the four projections 408-A, 408-B, 408-C and 408-D, the spaced-apart projections 2003-A and 2003-B on each side of the switch module 402, and the T-shaped clips 2303-A and 2303-B all combine to lock the switch module 402 in place within the central recess 407.

Figure 26:
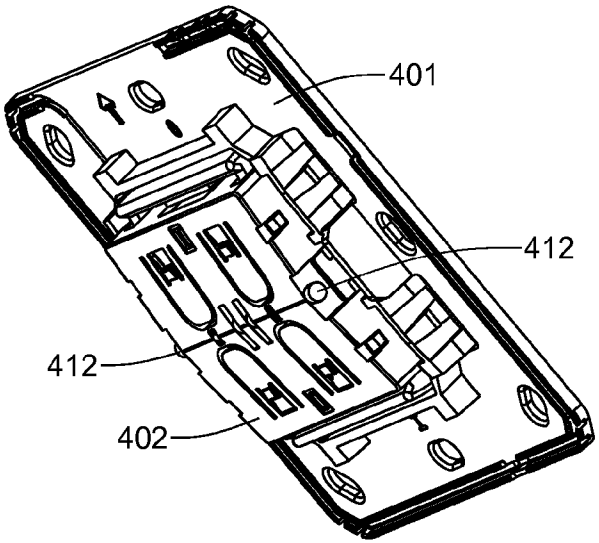
FIG. 26 is an isometric view of a surface-mount first embodiment back plate and energy-harvesting module assembly showing the perimetric channel or trough for installation of an external wire antenna.
Figure 25:
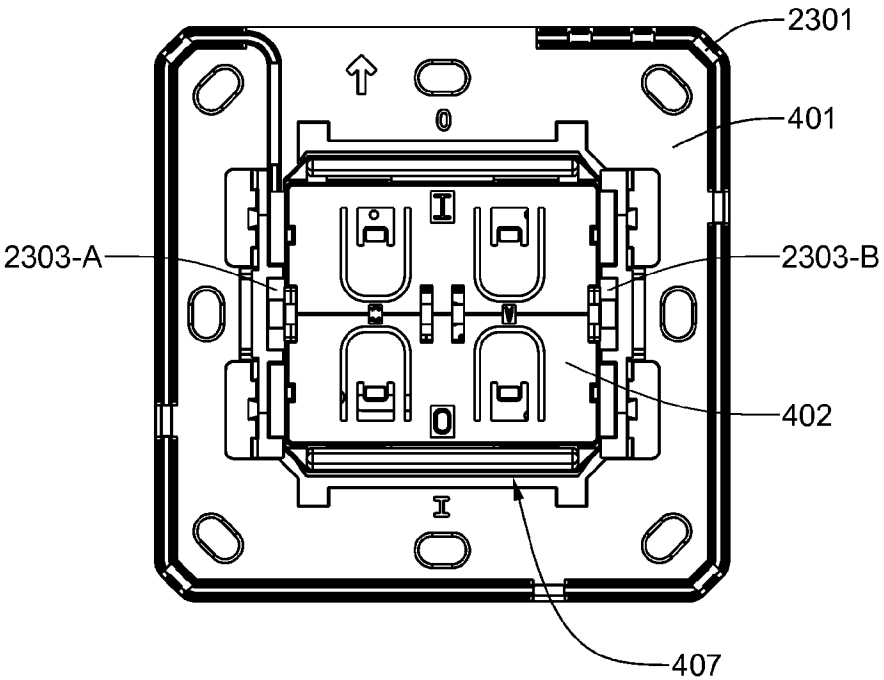
FIG. 25 is a front elevational view of a surface-mount first embodiment back plate and energy-harvesting module assembly showing the perimetric channel or trough that can be used for installation of an external wire antenna.

Referring now to FIGS. 25 and 26, the energy-harvesting switch module 402 has been installed in the central recess 407 of the back plate 401. It will be noted that the T-shaped clips 2302-A and 2302-B have snapped in place over the spaced-apart projections 2003-A and 2003-B on each side of the module 402.

Figure 27:
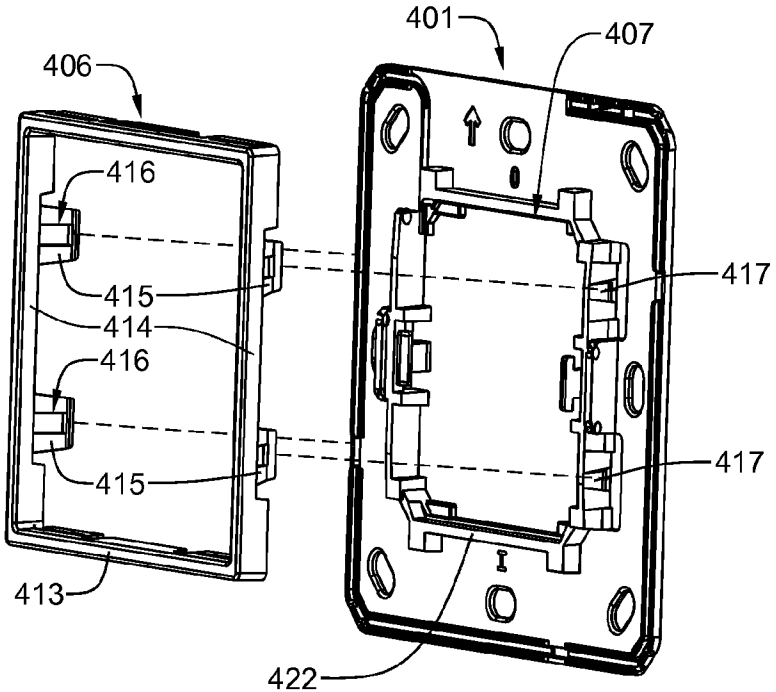
FIG. 27 is an isometric exploded view of the first embodiment retainer clip and back plate.

Referring now to FIG. 27, a first embodiment retainer clip 406 is shown aligned and ready for installation on a first embodiment back plate 401. As previously stated, the retainer clip 406 has a rectangular beam frame 413. Each side beam 414 of the retainer clip 406 is equipped with a pair of snap arms 415 having apertures 416 that will capture the latches 417 engage four latches on the outer surface of the wall 422 that surrounds the central recess 407.

Figure 28:
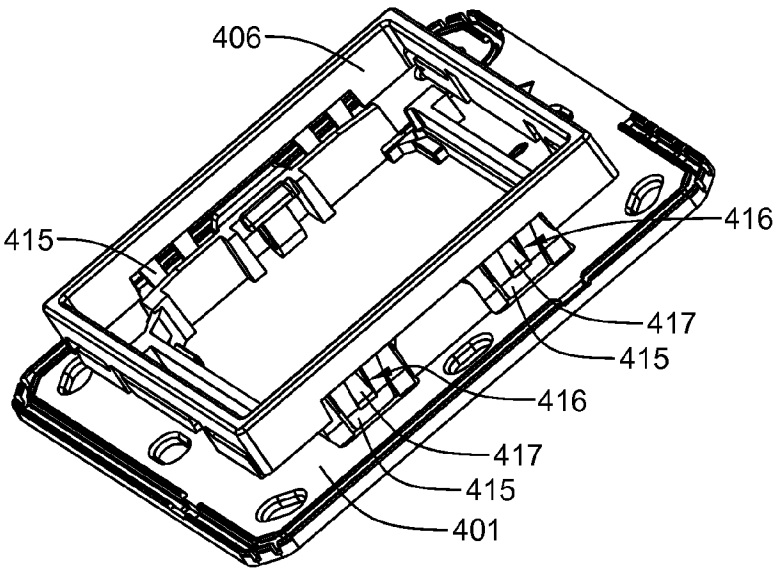
FIG. 28 is an isometric view of an assembled first embodiment retainer clip and back plate.

Referring now to FIG. 28, the loop 416 of each of the four snap arms 415 has engaged an associated latch 417 on the outer surface of the wall 422 that surrounds the central recess 407 of the back plate 401.

Figure 29:
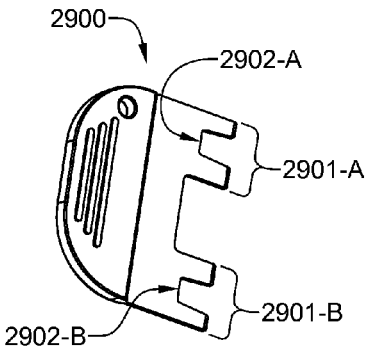
FIG. 29 is an isometric view of the removal tool.

Referring now to FIG. 29, a retainer clip removal tool 2900 is equipped with two sets of spaced-apart wedges 2901-A and 2901-B. Between each wedge pair 2901-A and 2901-B is a notch 2902-A and 2902-B, respectively. When the removal tool 2900 is inserted between the snap arms 415 of a single side beam 414 of the retainer clip 406 and the perimetric wall 422 that surrounds the central recess 407, the notches fit over both latches 417 on that side, and the snap arms 415 are pried away from the latches 417 so that both snap arms 415 are released from their associated latches 417.

Figure 30:
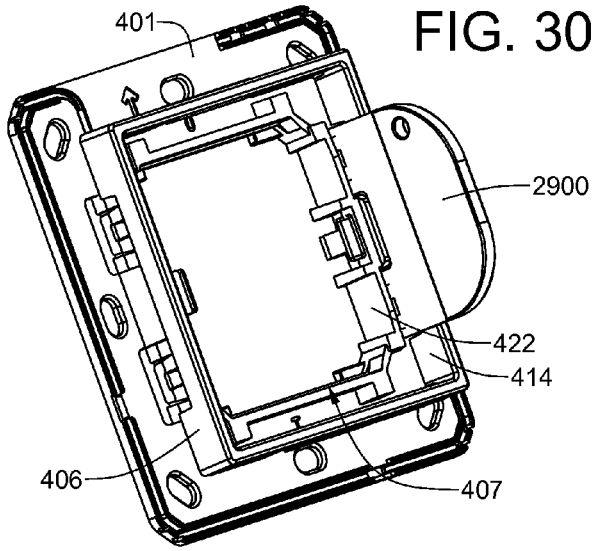
FIG. 30 is an isometric view of an assembled first embodiment retainer clip and back plate with a removal tool inserted therebetween to disengage the latches on one side of the back plate from the snap arms on the same side of the retainer clip.

Referring now to FIG. 30, a retainer clip removal tool 2900 is shown inserted between the snap arms 415 of a single side beam 414 of the retainer clip 406 and the perimetric wall 422 that surrounds the central recess 407, thereby releasing both snap arms 415 on that side of the retainer clip 406 from the associated latches 417 on the back plate 401.

Figure 31:
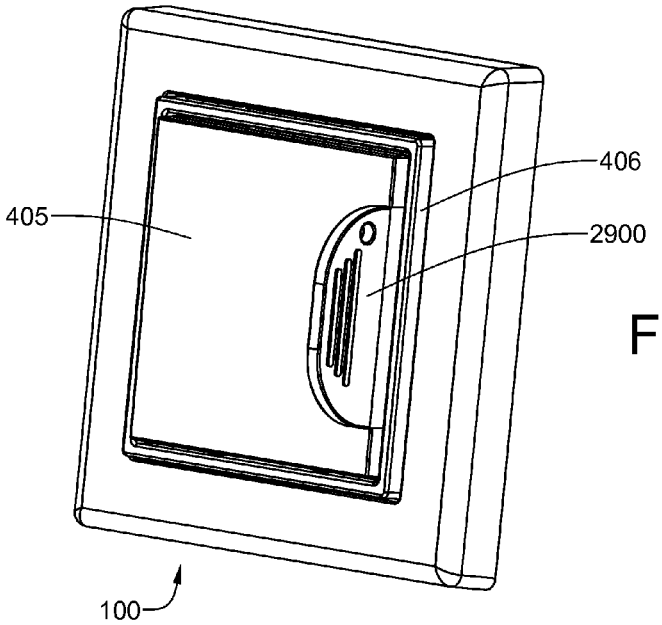
FIG. 31 is a an isometric view of a complete first embodiment switch assembly with a removal tool inserted between the single rocker and the retainer clip so as to disengage the latches on one side of the back plate from the snap arms on the same side of the retainer clip.

Referring now to FIG. 31, a retainer clip removal tool 2900 is shown inserted between the single rocker 405 and the retainer clip 406 of a completely assembled energy-harvesting switch assembly 100, thereby releasing both the unseen snap arms 415 on that side of the retainer clip 406 from the unseen associated latches 417 on the back plate 401. This enables that one side of the retainer clip 406 to be pulled slightly out of the assembly 100. The same step is repeated on the other side of the switch assembly 100, thereby enabling the retainer clip 406 to be withdrawn from the switch assembly 100 and the other components of the switch assembly 100 to be disassembled.

Figure 32:
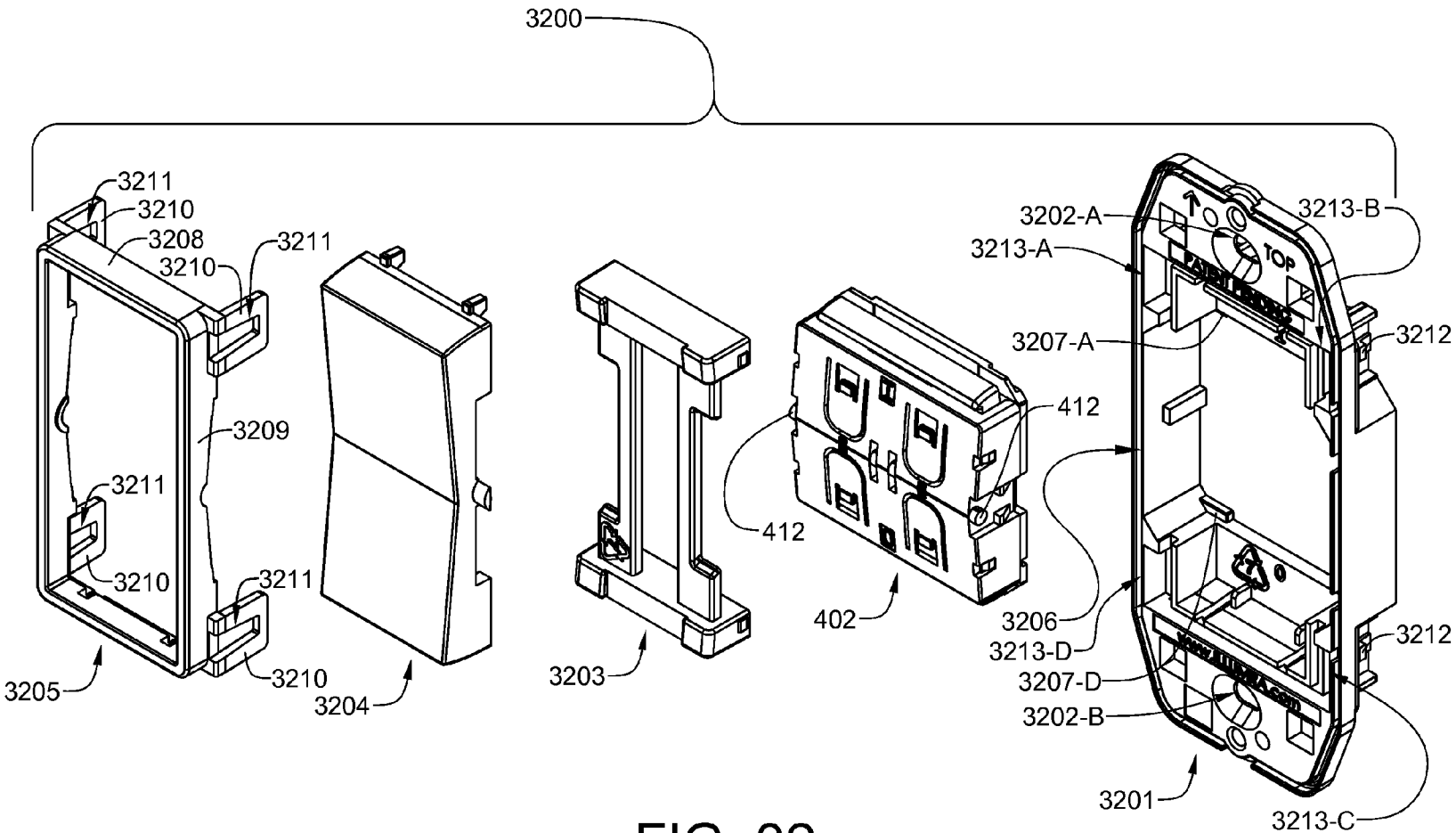
FIG. 32 is an isometric exploded view of the second embodiment improved, single-rocker, energy-harvesting switch assembly.

Referring now to FIG. 32, a second embodiment improved single-rocker, energy-harvesting switch assembly is shown as a collection of individual components 3200, which includes a flush-mount carrier 3201 that fits within a conventional single-gang U.S. or Canadian electrical wiring box. The flush-mount carrier 3201 is securable with 6-32 screws to the electrical wiring box which pass through apertures 3202-A and 3202-B in the carrier 3201. Also included in the collection of individual components 3200 are an energy-harvesting switch module 402 that is identical to that used in the first embodiment switch assemblies 100 and 200, a second embodiment single-rocker wear insert 3203, a second embodiment single rocker 3204, and a second embodiment retainer clip 3205. A trim plate (item 3401 of FIG. 34) will be attached to the carrier 3201 with decorative screws (items 3402-A and 3402-B of FIG. 34), which may be replaced with security screws to further hamper tampering with the switch assembly. Even if the trim plate is removed by a potential thief, there is a second round of defense. In order to assemble the improved second embodiment switch assembly 3200, the energy-harvesting switch module 402 is inserted into the receptacle 3206 of the carrier 3201. It will be noted that, as with the first embodiment back plate 401, there are four tabs 3207-A, 3207-B, 3207-C and 3207-D (only 3207-A and 3207-D are visible in this view) at the corners of the receptacle 3206 act as rear stops in the containment of an installed module. Next, second embodiment single-rocker wear insert 3203 is snapped onto the rear of the second embodiment single rocker 3204 and the rocker is snapped onto the outer pivot pins 412 of the switch module 402. It will be noted that the retainer clip 3205 has a rectangular beam frame 3208. Each side beam 3209 is equipped with a pair of snap arms 3210, each of which has a notch 3211 that is sized to engage a latch 3212 within a rectangular aperture 3213-A, 3213-B, 3213-C or 3213-D. Once the second embodiment retainer clip 3205 has engaged the latches 3212, the rocker 3204 and the energy-harvesting switch module 402 are secured within the carrier 3201. In order to release the retainer clip 3205 non-destructively, the carrier 3201 must be extracted from the wiring box by removing the screws that secure it to the box. Those screws can also be security screws to make the life of thieves more difficult.

Figure 33:
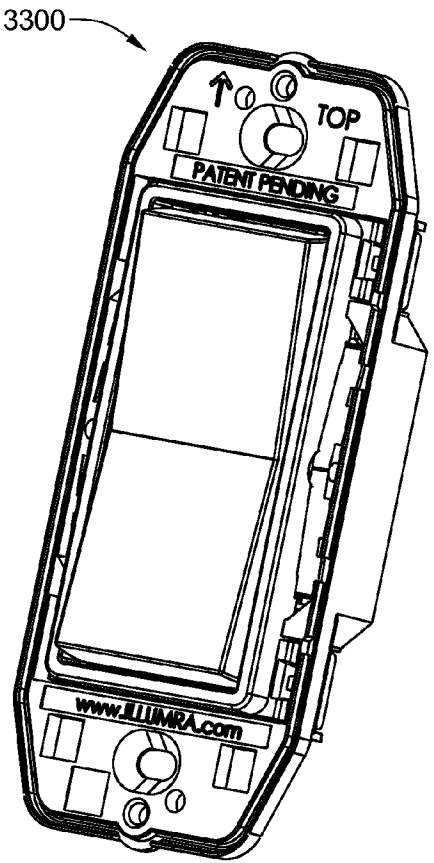
FIG. 33 is an isometric view of the assembled second embodiment improved single-rocker energy-harvesting switch assembly.

Referring now to FIG. 33, the individual components shown in FIG. 32 have been assembled into a complete second embodiment, single-rocker, energy-harvesting switch assembly 3300.

Figure 34:
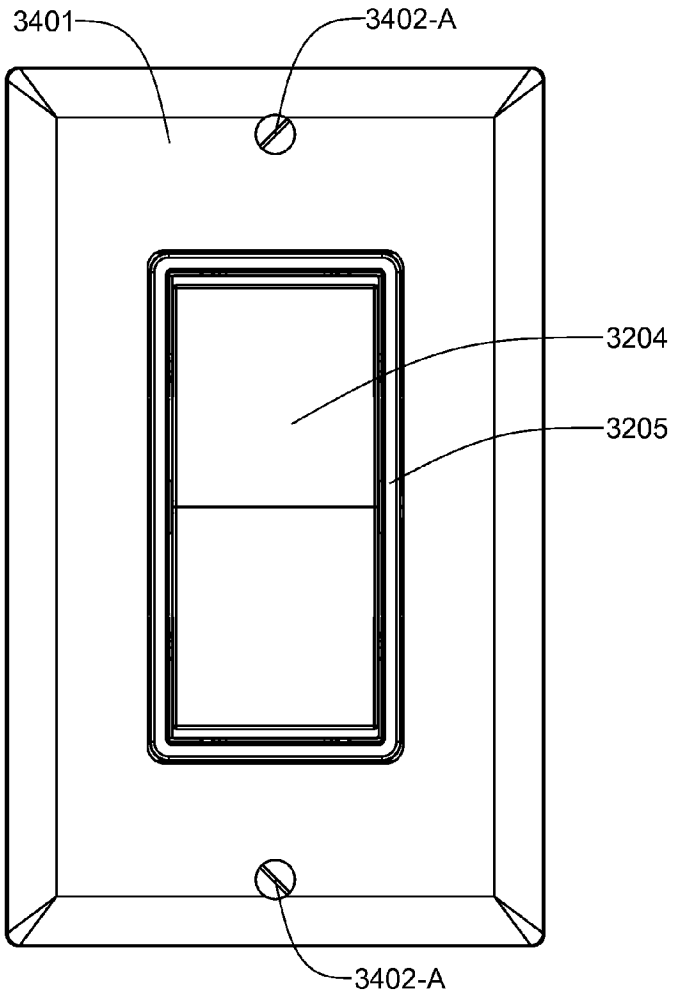
FIG. 34 is a front elevational view of a recessed-mount second embodiment, improved, single rocker energy-harvesting switch assembly designed primarily for U.S. and Canadian applications.

Referring now to FIG. 34, a face plate 3401 has been installed on the second embodiment switch assembly 3300 of FIG. 33. In this view, a second embodiment single rocker 3204 and a second embodiment retainer clip 3205 are also visible.

Figure 35:
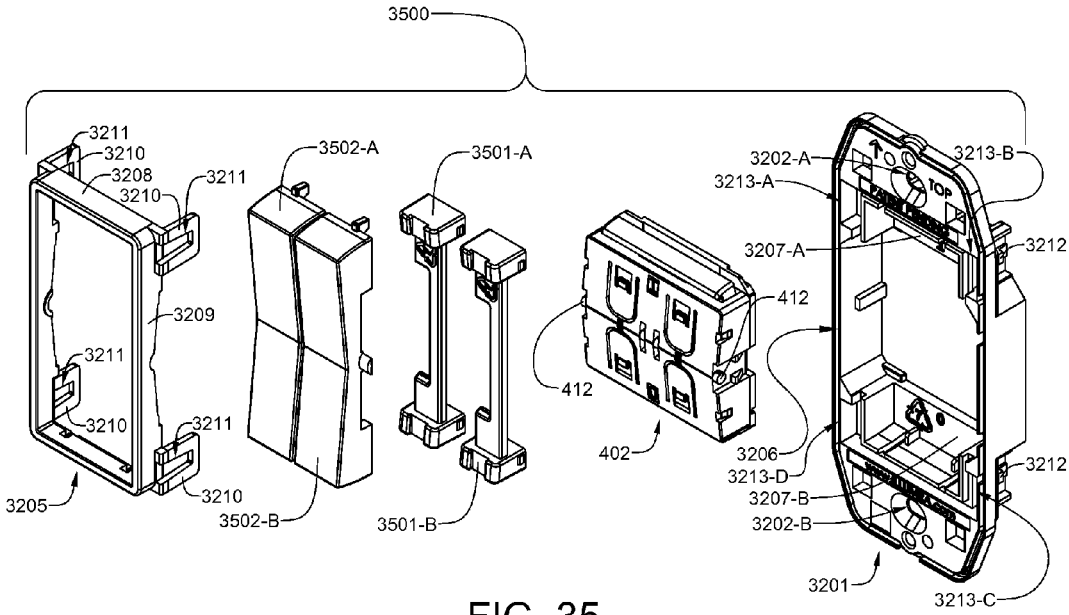
FIG. 35 is an isometric exploded view of a second embodiment, dual-rocker, energy-harvesting switch assembly.

Referring now to FIG. 35, the flush-mount second embodiment improved dual-rocker energy-harvesting switch assembly 3500 includes a carrier 3201, an energy harvesting switch module 402, a pair of second embodiment dual-rocker wear inserts 3501-A and 3501-B (which are interchangeable), a pair of second embodiment half-width rockers 3502-A and 3502-B, and a retainer clip 3205. The second embodiment dual-rocker switch assembly 3500 differs from the single-rocker embodiment assembly 3200 only in the design of the double rocker set 3502-A/3502-B and the wear inserts 3501-A/3501-B. The discussion about operability of the switch tabs by the double rockers of the first embodiment double-rocker switch assembly 200 applies completely to the operability of the switch tabs by the double rockers 3502-A and 3502-B of this second embodiment assembly. It should be evident that the conventional trim plates which are attached to the carrier 3201 of the second embodiment energy-harvesting switch module 3300 or 3600 with screws can be replaced with a screwless trim plate which is held to the switch assembly 3300 or 3600 using techniques that are used for the first embodiment energy-harvesting switch module 100 or 200. Alternatively, the trim plate may be molded as part of the second embodiment retainer clip 3205.

Figure 36:
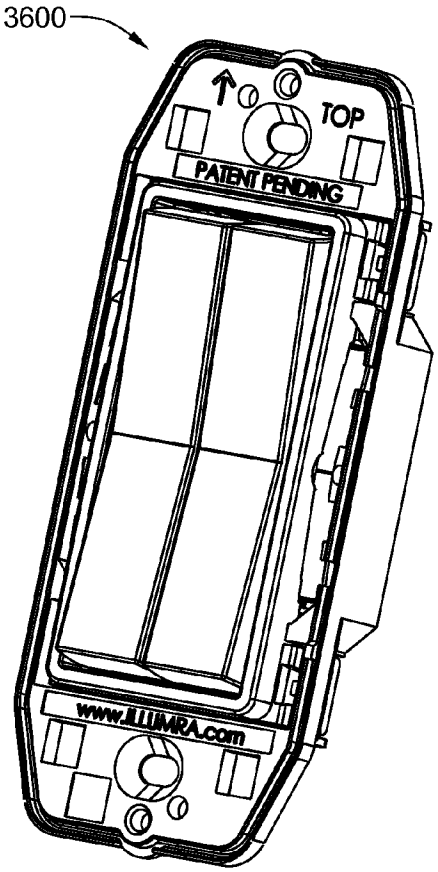
FIG. 36 is an isometric view of the assembled second embodiment improved double-rocker energy-harvesting switch assembly.

Referring now to FIG. 36, the individual components shown in FIG. 35 have been assembled into a complete second embodiment, double-rocker, energy-harvesting switch assembly 3600.

Figure 37:
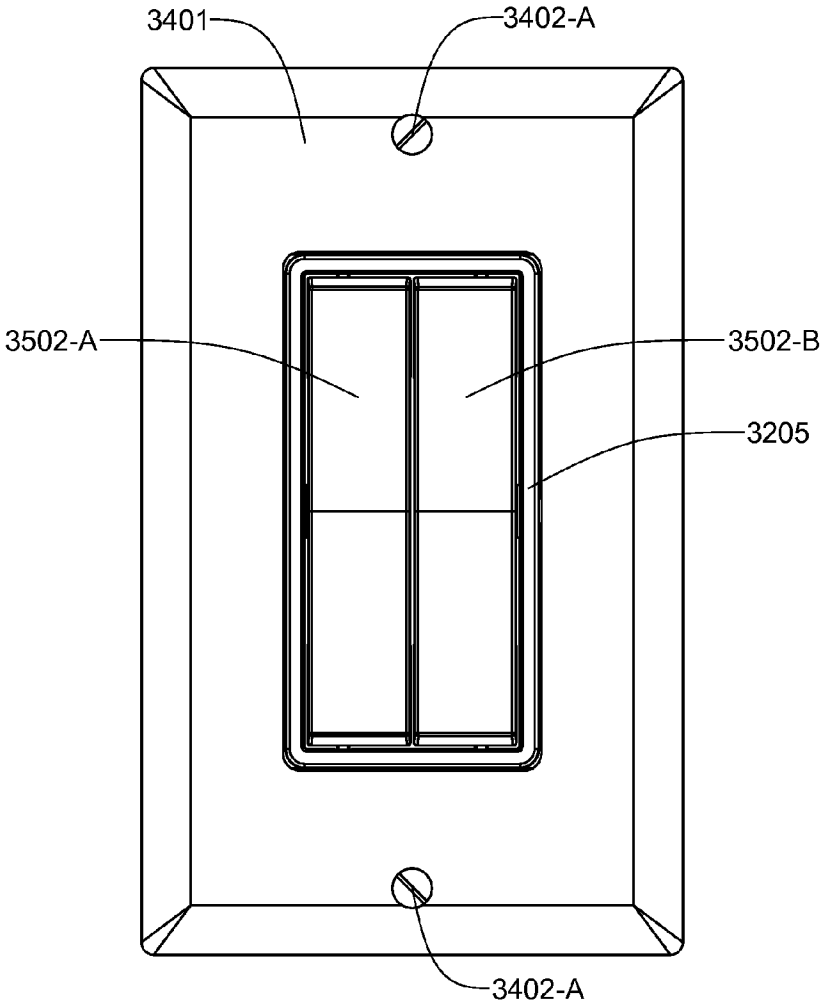
FIG. 37 is a front elevational view of a recessed-mount second embodiment, improved, dual-rocker energy-harvesting switch assembly designed primarily for U.S. and Canadian applications.

Referring now to FIG. 37, a face plate 3401 has been installed on the second embodiment switch assembly 3600 of FIG. 36. In this view, a second embodiment double rocker 3502-A/3502-B and a second embodiment retainer clip 3205 are also visible.

The wear inserts used to implement certain aspects of the present invention are designed so that a large contact area—rather than several small bumps or projections—pushes against each bow. The wear-resistant polymer material can be polymers such as Teflon®, nylon, or polymer alloys such as acrylonitrile butadiene styrene (ABS)/polycarbonate (PC) alloy. The wear-resistant nature of the insert is expected to at least quadruple the life expectancy of the rocker so that its life expectancy is at least commensurate with that of the energy-harvesting switch module.

Although only several embodiments of the invention have been described herein, it should be obvious to those having ordinary skill in the art that changes and modifications may be made thereto without departing from the scope and the spirit of the invention as hereinafter claimed.

What is claimed is:

1. An improved, energy-harvesting switch assembly including, as individual components thereof, a retainer clip having a generally rectangular frame, at least one rocker, a decorative face plate, a carrier, and an energy-harvesting switch module having energy bows, said energy-harvesting module generating an induced current pulse and transmitting a radio frequency signal packet in response to pressure on the rocker, which causes the energy bows to snap, wherein the improvement comprises:

said at least one rocker has been modified so that it has at least one tab which extends from an upper edge and from a lower edge thereof;

said retainer clip has been modified so that it has recesses on upper and lower frame members, said recesses capturing said at least one tab on the upper edge and said at least one tab on the lower edge of said at least one rocker so that said at least one rocker cannot be removed from the assembly without removing the retainer clip; and said carrier and said retainer clip have been modified so that when the individual components are assembled, the carrier and the retainer clip lock together in a manner that precludes non-destructive disassembly without use of a unique tool having strategically-spaced, multiple wedge-shaped release prongs, which slides into gaps between adjacent components of the assembly and unlatches at least a portion of the retainer clip from the carrier.

2. The improved, energy-harvesting switch assembly of claim 1, wherein modification of the retainer clip comprises providing a plurality of snap arms located on a periphery of the rectangular frame, each of said snap arms having an aperture; and wherein modification of the carrier comprises providing a plurality of latches, each of which captures an aperture of one snap arm; and wherein the latches are accessible and releasable only with said unique tool, which has two sets of spaced-apart wedge pairs, with the wedges of each wedge pair having a notch therebetween that fits over a latch on the carrier, thereby allowing the wedges to simultaneously lift both sides of a snap arm whose aperture has engaged the latch, thereby unlatching at least a portion of said retainer clip from said carrier.

3. The improved, energy-harvesting switch assembly of claim 1, wherein the carrier is further modified by providing a perimetric channel into which a wire antenna, required for operation in a particular radio frequency band, can be pressed.

4. The improved, energy-harvesting switch assembly of claim 1, wherein said at least one rocker is further modified so that so that at least one wear-resistant insert, which contacts the energy bows, snaps into the rear of said at least one rocker.

5. The improved, energy-harvesting switch assembly of claim 1, wherein the carrier and the retainer clip latch together within the module so that latch mechanisms are not visible.

6. An energy-harvesting switch assembly comprising:

a retainer clip having a generally rectangular frame;

at least one rocker, positioned within said rectangular frame;

a carrier having latches thereon which interlock with snap arms on said retainer clip;

a decorative face plate secured to the assembly by the retainer clip; and an energy-harvesting switch module, which snaps into a recess within said carrier, said switch module having spaced-apart pivot pins to which said at least one rocker is pivotally attached, said switch module also having a pair of energy bows, said energy-harvesting switch module generating an induced current pulse and transmitting a radio frequency signal packet in response to pressure on said at least one rocker, which causes the energy bows to snap;

wherein disassembly of said retainer clip from said carrier requires the use of a unique tool having two sets of spaced-apart wedge pairs, with the wedges of each wedge pair having a notch therebetween that fits over a latch on the carrier, thereby allowing the wedges to simultaneously raise both sides of a snap arm that has engaged the latch, said two sets of spaced-apart wedge pairs sliding into gaps between adjacent components of the assembly and unlatching said retainer clip from said carrier.

7. The energy-harvesting switch assembly of claim 6, wherein said retainer clip and said carrier cannot be unlocked and separated from one another without the use of a unique tool.

8. The energy-harvesting switch assembly of claim 7, wherein said unique tool is a laminar device which slips into at least one gap between adjacent components of said switch assembly.

9. The energy-harvesting switch assembly of claim 8, wherein said laminar device slips between said an outer periphery of said at least one rocker and an inner periphery of said retainer clip.

10. The energy-harvesting switch assembly of claim 6, wherein said retainer clip is provided with a plurality of snap arms located on a periphery of the rectangular frame, each of said snap arms having an aperture, and wherein said carrier is provided with a plurality of latches, each of which captures an aperture of one snap arm, and wherein said latches are accessible and releasable only with a unique tool insertable into said assembly.

11. The energy-harvesting switch assembly of claim 6, wherein the carrier is provided with a perimetric channel into which a wire antenna, required for operation in a particular radio frequency band, can be pressed.

12. The energy-harvesting switch assembly of claim 6, which further comprises at least one wear-resistant insert, which contacts the energy bows, and which snaps into the rear of said at least one rocker.

13. The energy-harvesting switch assembly of claim 6, wherein the carrier and the retainer clip latch interlock within the switch assembly so that interlocking mechanisms are not visible.

14. An energy-harvesting switch assembly comprising:

a retainer clip having a generally rectangular frame;

at least one rocker, positioned within said rectangular frame;

a carrier which interlocks with said retainer clip to hold the entire assembly together in such a manner that it cannot be non-destructively disassembled without use of a unique tool having strategically-spaced, multiple wedge-shaped release prongs, which slides into gaps between adjacent components of the assembly and unlatches the retainer clip from the carrier;

a decorative face plate secured to the assembly by the retainer clip; and an energy-harvesting switch module, which snaps into a recess within said carrier, said switch module having spaced-apart pivot pins to which said at least one rocker is pivotally attached, said switch module also having a pair of energy bows, said energy-harvesting switch module generating an induced current pulse and transmitting a radio frequency signal packet in response to pressure on said at least one rocker, which causes the energy bows to snap.

15. The energy-harvesting switch assembly of claim 14, wherein said unique tool is a laminar device which slips between adjacent components of said switch assembly and releases locking latches.

16. The energy-harvesting switch assembly of claim 15, wherein said laminar device slips between said an outer periphery of said at least one rocker and an inner periphery of said retainer clip.

17. The energy-harvesting switch assembly of claim 14, wherein said retainer clip is provided with a plurality of snap arms located on a periphery of the rectangular frame, each of said snap arms having an aperture, and wherein said carrier is provided with a plurality of latches, each of which captures an aperture of one snap arm, and wherein said latches are accessible and releasable only with the unique tool, which is a laminar tool insertable within gaps between individual components of said assembly.

18. The energy-harvesting switch assembly of claim 14, wherein the carrier is provided with a perimetric channel into which a wire antenna, required for operation in a particular radio frequency band, can be pressed.

19. The energy-harvesting switch assembly of claim 14, which further comprises at least one wear-resistant insert, which contacts the energy bows, and which snaps into the rear of said at least one rocker.

* * * * *